US012638244B2

(12) United States Patent
Khatsenko et al.

(10) Patent No.: US 12,638,244 B2
(45) Date of Patent: May 26, 2026

(54) VACUUM SPRAY BOILER

(71) Applicant: Blue Origin Manufacturing, LLC, Huntsville, AL (US)

(72) Inventors: Maxim Oleg Khatsenko, San Diego, CA (US); Michael Anton Feigenblatt, Seattle, WA (US); Jason Alan Cooper, Deerfield Beach, FL (US); Patrick Wade, Kent, WA (US)

(73) Assignee: Blue Origin Manufacturing, LLC, Huntsville, AL (US)

( * ) Notice: Subject to any disclaimer, the term of this patent is extended or adjusted under 35 U.S.C. 154(b) by 202 days.

(21) Appl. No.: 18/465,806

(22) Filed: Sep. 12, 2023

(65) Prior Publication Data

US 2025/0085059 A1 Mar. 13, 2025

(51) Int. Cl.

| | |
|---|---|
| ***F28D 9/00*** | (2006.01) |
| *F28D 21/00* | (2006.01) |
| *F28F 25/06* | (2006.01) |

(52) U.S. Cl.

CPC .... *F28D 9/0006* (2013.01); *F28D 2021/0021* (2013.01); *F28D 2021/004* (2013.01); *F28F 25/06* (2013.01)

(58) Field of Classification Search

CPC .. F28D 5/02; F28D 9/0006; F28D 2021/0021; F28D 2021/004; F28D 2021/0089; F28F 25/06

See application file for complete search history.

(56) References Cited

FOREIGN PATENT DOCUMENTS

WO 2019099928 5/2019

OTHER PUBLICATIONS

Newland, Russell L. III, "APU/Hydraulic/Water Spray Boiler Systems Training Manual," Space Program Operations Contract, Oct. 14, 2008 (Year: 2008).*

O'Connor et al., "Shuttle Water Spray Boiler Flight Performance", SAE Technical Paper Series, 12th Intersociety Conference on Environmental Systems, San Diego, California, Jul. 19-21, 1982 (Year: 1982).*

O'Connor et al., "Shuttle Water Spray Boiler Flight Performance", SAE Technical Paper Series, 12th Intersociety Conference on Environmental Systems, San Diego, California, Jul. 19-21, 1982.

Newland, Russell L. III, "APU/Hydraulic/Water Spray Boiler Systems Training Manual," Space Program Operations Contract, Oct. 14, 2008.

* cited by examiner

*Primary Examiner* — Eric S Ruppert
*Assistant Examiner* — Hans R Weiland
(74) *Attorney, Agent, or Firm* — Summit Patents, PC

(57) ABSTRACT

A heat exchanger system, in particular a vacuum spray boiler, cools a hot fluid by spraying a coolant onto chambers carrying the hot fluid. This process may be performed in i) a vacuum, as in space, ii) atmospheric pressure, as on a launch pad of a space vehicle, or iii) any pressure therebetween. The heat exchanger system may incorporate a plate-fin heat exchanger. A coolant spray apparatus, used for spraying the coolant, and the heat exchanger are integrated within a vacuum chamber. The coolant, subsequent to changing to a vapor state after being sprayed onto the heat exchanger, may be exhausted to outside the system.

20 Claims, 3 Drawing Sheets

VACUUM SPRAY BOILER

BACKGROUND

Airplane hydraulic oil coolers have heat exchangers embedded in fuel tanks using the fuel as coolant. However, they are not mass efficient because they do not boil the coolant. Boiling coolant is preferred for spaceflight applications to save mass. However, because boiling coolant is difficult in microgravity, a spraying architecture has been used. This latter type of cooling architecture may be performed by a water spray boiler (WSB), which was used on the Space Shuttle.

The WSB is a thermal control system that provides passive and active cooling capabilities to cool down hydraulic oil, for example, or other fluid. Cooling occurs in a heat exchanger that doubles as a container for the cooling liquid. Cooling is achieved by spraying water (or some water-based mixture) onto tubes (or channels) that contain flowing fluid to be cooled. The sprayed water generally converts to water vapor by the relatively hot tubes, and this vapor is vented to outside the space vessel.

Though the WSB has been used numerous times with success, there have also been problems. For example, because the WSB is generally operated during space flight where temperatures are very cold, freezing of coolant (e.g., the water) may occur and block flow of the coolant or vents thereof. Another problem with a WSB is its mass, which is relatively high and undesirable for repeatable and economical space flight, where mass considerations are particularly important.

BRIEF DESCRIPTION OF THE DRAWINGS

The disclosure will be understood more fully from the detailed description given below and from the accompanying figures of embodiments of the disclosure. The figures are used to provide knowledge and understanding of embodiments of the disclosure and do not limit the scope of the disclosure to these specific embodiments. Furthermore, the figures are not necessarily drawn to scale.

DETAILED DESCRIPTION

Figure 1:
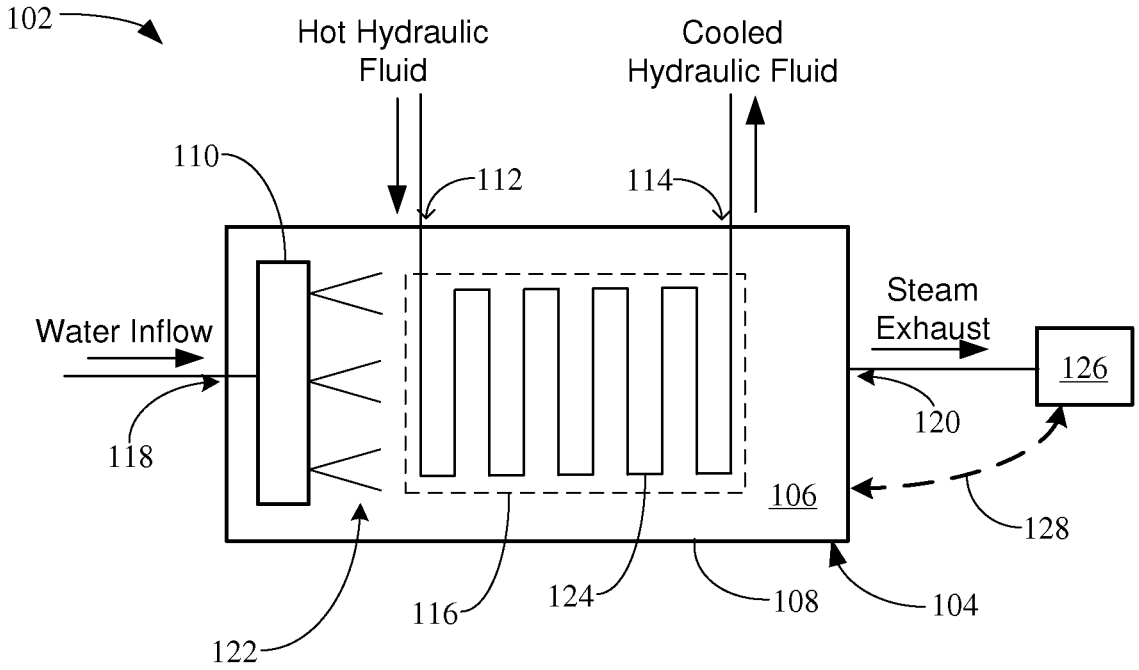
FIG. 1 illustrates a schematic depiction of a vacuum spray boiler, according to some embodiments.

This disclosure describes architectures for a heat exchanger system, in particular a vacuum spray boiler, for cooling a hot fluid by spray boiling a coolant in vacuum (e.g., as in space), atmospheric pressure (e.g., as on the launch pad of a space vehicle), or any pressure therebetween. As explained below, hot fluid flows in a plate-fin heat exchanger while a coolant spray apparatus, integrated with the heat exchanger, delivers coolant via spraying from nozzles. The coolant consequently phase changes from a sprayed fluid state to a boiled vapor, which is then exhausted to outside the system.

In some embodiments, a vacuum spray boiler cooling system for cooling a fluid includes a vacuum tank. In some implementations, the system need not operate in a vacuum and the "vacuum" tank need not be a tank capable of holding a vacuum. In other implementations, the vacuum tank is a chamber capable of holding a vacuum. Regardless of implementation, examples herein will recite a "vacuum" tank, though claimed subject matter is not so limited.

The vacuum tank includes an enclosed space at least partially surrounded by a casing, which may be aluminum, for example. The casing comprises sides and a lid, which includes a coolant inlet. The lid further includes a coolant spray apparatus connected to one or more nozzles, which may protrude from the lid, in the enclosed space.

A number of components are integrated with the vacuum tank such that these components and the vacuum tank are a single integrated apparatus. In other words, these components are built into the vacuum tank. These components include a fluid inlet and a fluid outlet, both penetrating the casing, for carrying the fluid through the casing. Other components integrated with the vacuum tank are the coolant spray apparatus and a heat exchanger in the enclosed space. The coolant spray apparatus is configured for spraying coolant, via one or more nozzles, onto the heat exchanger. The heat exchanger may be a plate-fin heat exchanger, which may comprise serpentine-shaped chambers to carry the fluid to be cooled. Still other components integrated with the vacuum tank are a coolant inlet and a coolant exhaust port at least partially penetrating the casing. The coolant inlet is configured for carrying the coolant to the coolant spray apparatus and the coolant exhaust port is configured for carrying vaporized coolant away from the enclosed space.

In addition to the integrated vacuum tank, the vacuum spray boiler cooling system includes an exhaust vent connected to the coolant exhaust port. The exhaust vent is in thermal contact with a portion of the components, as explained below. The exhaust vent may be configured to release the vaporized coolant from the system. Such thermal contact may allow for heating of the vented vaporized coolant, which may otherwise quickly cool to a solid state (e.g., from steam to ice) as the coolant travels toward the exterior of the space vehicle, which is generally extremely cold. Thus, such thermal contact may help maintain the vaporized coolant at a temperature above its freezing point. In other words, heat energy from at least a portion of the vacuum spray boiler cooling system may be transferred, via the thermal contact, to the exhaust vent.

In some embodiments, because spray nozzles of the coolant spray apparatus are integrated with, and relatively close to, a relatively warm heat exchanger inside the enclosed space of the vacuum tank, these spray nozzles may remain relatively warm. This situation, e.g., thermal contact between the heat exchanger and the spray nozzles, allows for prevention of coolant freezing at the nozzles, which could otherwise occur in the extreme cold temperature of space.

FIG. 1 illustrates a vacuum spray boiler 102 that may be used to cool a fluid, according to some embodiments. Vacuum spray boiler 102 includes a vacuum tank 104 having an enclosed space 106, a casing 108, a coolant spray apparatus 110, a fluid inlet 112, a fluid outlet 114, a heat exchanger 116, a coolant inlet 118, and a coolant exhaust port 120. In some implementations, the fluid may be hydraulic fluid, as indicated in FIG. 1, and the coolant may be pure water or a water-based mixture, though claimed subject matter is not so limited.

Coolant spray apparatus 110 may include nozzles 122 that substantially direct coolant, such as water, toward cooling chambers 124 of heat exchanger 116. In this way, coolant spray apparatus 110 is configured for spraying coolant onto heat exchanger 116. Coolant inlet 118 may receive coolant from a reservoir tank (e.g., from which the coolant may be moved via a pump, though a pump may not be necessary, wherein coolant may move via residual pressure in the tank) and carry the coolant to coolant spray apparatus 110. In some implementations, at least a portion of the coolant may be sourced from recirculated coolant. Generally, upon contact with cooling chambers 124, which are relatively hot, coolant sprayed onto these chambers will phase transition from liquid to a vapor. Coolant exhaust port 120 is configured for carrying the vaporized coolant away from enclosed space 106.

In addition to the vacuum tank and its integrated components, a cooling system that includes vacuum spray boiler 102 may also include an exhaust vent 126 connected to coolant exhaust port 120. The exhaust vent may be configured to release vaporized coolant from the system. For example, vaporized coolant may be released into space from the vehicle carrying the cooling system. The exhaust vent may be in thermal contact, indicated by dashed double arrow 128, with a portion of the components. As mentioned above, such thermal contact may help maintain the vaporized coolant at a temperature above its freezing point. Thus, heat energy from at least a portion of vacuum spray boiler 102 may be transferred, via the thermal contact, to exhaust vent 126. Such thermal contact may arise via conduction heating from heat exchanger 116 to exhaust vent 126. In some implementations, inlet tubing (not shown) may be connected to fluid inlet 112 to carry hot fluid (to be cooled) from a source such as machinery or an engine, for example, to vacuum spray boiler 102. In this case, the thermal contact may arise via conduction, convection, and/or radiation heating, based on ambient conditions surrounding the system (e.g., conduction and/or radiation heating in space, and convection heating in air), from the fluid in the inlet tubing to the exhaust vent.

Figure 2:
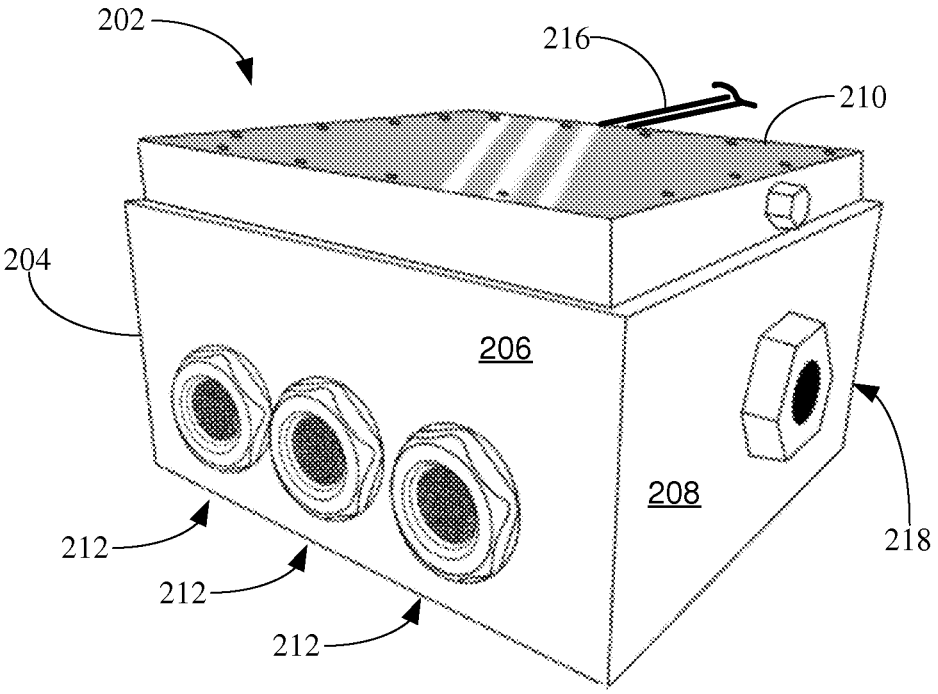
FIG. 2 is a perspective view of a vacuum spray boiler, according to some embodiments.

FIG. 2 is a perspective view of a vacuum spray boiler 202, according to some embodiments. Vacuum spray boiler 202 may be similar to or the same as vacuum spray boiler 102. FIG. 2 is useful for describing the integrated nature of the components of which vacuum spray boiler 202 comprises. For example, vacuum spray boiler 202 is illustrated as a single-piece apparatus that integrates together a number of components. Essentially all that is needed for functionality of vacuum spray boiler 202, being a single-piece apparatus, are connections of its ports to external tubes, hoses, or pipes, for example.

Vacuum spray boiler 202 includes a vacuum tank 204 having an enclosed space, such as 106 in FIG. 1. Vacuum tank 204 may comprise a casing 206, which may be made of aluminum, which is fairly light weight and relatively easy to machine. Casing 206 may include sides 208 and a lid 210, which may be attached or removed from sides 208 via a number of bolts or other attachments. Vacuum spray boiler 202 may also include sight glasses 212 (e.g., windows) for viewing into the inside of the vacuum spray boiler. Further, vacuum spray boiler 202 also includes a coolant inlet 216, and a coolant exhaust port 218, which may be similar to or the same as coolant inlet 118 and coolant exhaust port 120, respectively.

A coolant spray apparatus, such as 110, may be included in lid 210 in the form of channels for coolant to flow from coolant inlet 216 to spray nozzles, such as 122, which may substantially direct the coolant toward cooling chambers (e.g., 124) of a heat exchanger (e.g., 116). Inside casing 206, and not visible in FIG. 2, is a heat exchanger (e.g., 116). Coolant inlet 216 may receive coolant from a tank (not shown) and carry the coolant to the coolant spray apparatus. Upon contact with cooling chambers of the heat exchanger, coolant sprayed onto these chambers may transition from liquid to a vapor. Coolant exhaust port 218 is configured for carrying the vaporized coolant away from the enclosed space of vacuum tank 204.

Figure 3:
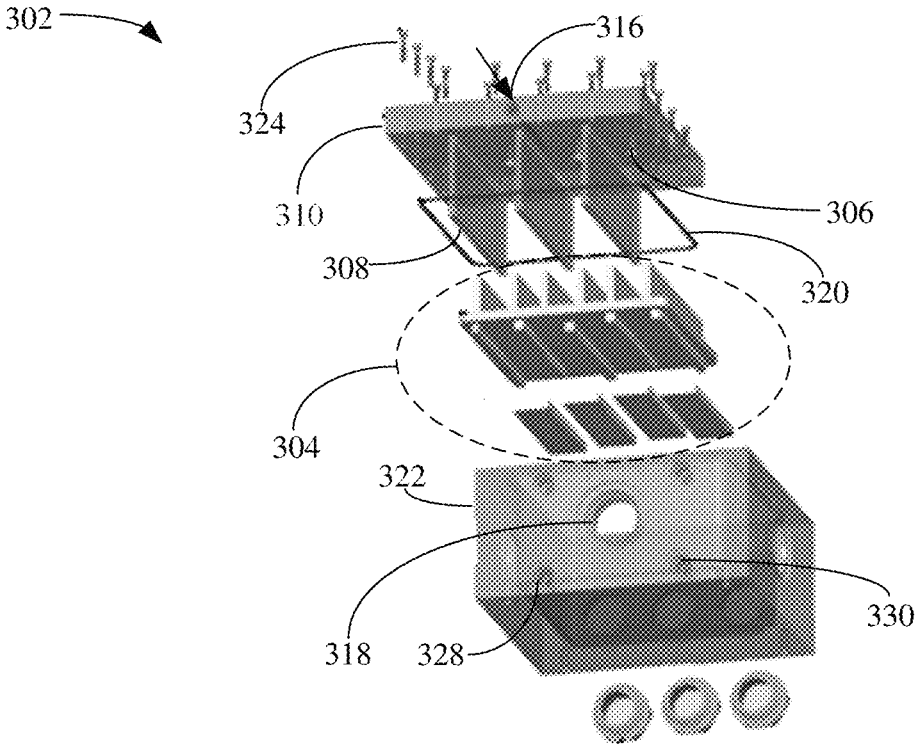
FIG. 3 is a perspective exploded view of a vacuum spray boiler, according to some embodiments.

FIG. 3 is a perspective exploded view of a vacuum spray boiler 302, according to some embodiments. Vacuum spray boiler 302 may be similar to or the same as vacuum spray boiler 202, wherein some components that are inside casing 206 are visible in FIG. 3. These components include a heat exchanger 304 and spray nozzles 306. In some implementations, fins 308 attached to lid 310 may protrude downward from the lid and reach within relatively close proximity to heat exchange 304. Such a configuration may allow for transferring heat from the heat exchange to the lid and the spray nozzles, thus preventing coolant freezing in or around the spray nozzles.

Also illustrated in FIG. 3, vacuum spray boiler 302 includes a fluid (e.g., oil) inlet 328 and a fluid outlet 330. Further, vacuum spray boiler 302 also includes a coolant inlet 316, and an instrument port 318. In some implementations, a gasket 320 may be used to form a vacuum seal between lid 310 and casing 322. Additionally, bolts 324, or other type of attachment, may be used to fasten lid 310 to casing 322.

Figure 4:
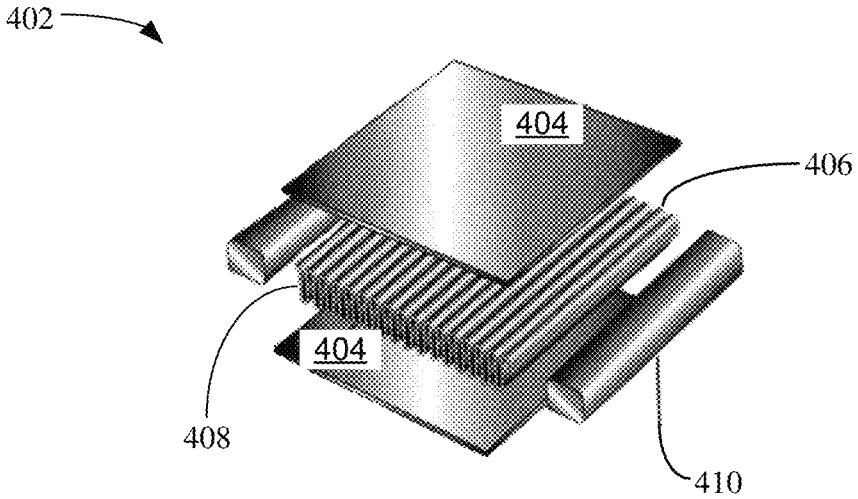
FIG. 4 is a perspective exploded view of a heat exchanger having a plate-fin architecture, according to some embodiments.

FIG. 4 is a perspective exploded view of a heat exchanger 402 having a plate-fin architecture, according to some embodiments. Generally, a plate-fin heat exchanger is made of layers of corrugated sheets separated by flat metal plates to create a series of finned chambers. In particular, heat exchanger 402 may comprise plates 404 and finned chambers 406 formed between the plates. Each "chamber" or channel is enclosed by adjacent plates and adjacent fins 408. Heat of fluid or gas flowing in finned chambers 406 may be transferred to the metal of plates 404 and fins 408. Sides 410 may be used to interconnect and seal adjacent plates 404.

A plate-fin heat exchanger, such as 402, provides a number of advantages for use in space vehicles. For example, it is relatively compact with a high heat-transfer-surface-area to volume ratio. Heat exchanger 402 may be fabricated from aluminum or aluminum alloy (e.g., a brazed aluminum heat exchanger), or other metals, such as stainless steel.

Heat exchanger 402, which may be the same as or similar to, heat exchanger 116 of FIG. 1, may be in enclosed space 106, for example, of vacuum spray boiler 102. Finned chambers 406 may be connected to fluid inlet 112 and fluid outlet 114 so that fluid to be cooled may be moved (e.g., via a pump or without a pump and moved via residual pressure in a tank) through the heat exchanger. Within enclosed space 106, nozzles 122 of coolant spray apparatus 110 spray coolant, such as water, onto finned chambers 406 (e.g., cooling chambers 124) of the heat exchanger.

Figure 5:
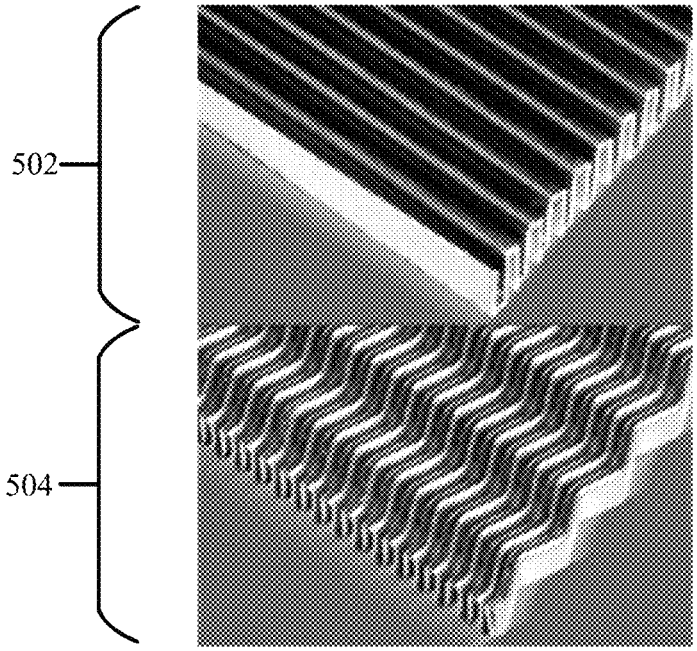
FIG. 5 includes images of perspective views of linear and serpentine fins, respectively, of a heat exchanger, according to some embodiments.

FIG. 5 includes images of perspective views of linear fins 502 and serpentine fins 504, respectively, of a heat exchanger, according to some embodiments. For example, heat exchanger 402, having a plate-fin architecture, may incorporate serpentine fins 504, though claimed subject matter is not so limited.

Plate-fin heat exchangers may incorporate any of several types of fins. For example, a plain configuration has a straight-finned triangular or rectangular design. A herring-bone configuration has fins that are placed sideways to provide a zig-zag path. A serrated and perforated configuration has cuts and perforations in the fins to augment flow distribution and improve heat transfer. A serpentine configuration, such as 504, has fins that are sinuous, as illustrated in FIG. 5.

The foregoing description, for purposes of explanation, used specific nomenclature to provide a thorough understanding of the disclosure. However, it will be apparent to one skilled in the art that the specific details are not required in order to practice the systems and methods described herein. The foregoing descriptions of specific embodiments or examples are presented by way of examples for purposes of illustration and description. They are not intended to be exhaustive of or to limit this disclosure to the precise forms described. Many modifications and variations are possible in view of the above teachings. The embodiments or examples are shown and described in order to best explain the principles of this disclosure and practical applications, to thereby enable others skilled in the art to best utilize this disclosure and various embodiments or examples with various modifications as are suited to the particular use contemplated. It is intended that the scope of this disclosure be defined by the following claims and their equivalents.

We claim:

1. A vacuum spray boiler cooling system for cooling a fluid, the system comprising:

a vacuum tank having an enclosed space at least partially surrounded by a casing;

components integrated within the vacuum tank, the components comprising:

a fluid inlet and a fluid outlet penetrating the casing, the fluid inlet and the fluid outlet for carrying the fluid through the casing;

a heat exchanger in the enclosed space;

a coolant spray apparatus including one or more spray nozzles in the enclosed space, the coolant spray apparatus for spraying coolant onto the heat exchanger; and a coolant inlet and a coolant exhaust port at least partially penetrating the casing, the coolant inlet for carrying the coolant to the coolant spray apparatus and the coolant exhaust port for carrying vaporized coolant away from the enclosed space; and an exhaust vent connected to the coolant exhaust port and in thermal contact with a portion of the components, the exhaust vent to release the vaporized coolant from the system.

2. The vacuum spray boiler cooling system of claim 1, wherein the casing includes a lid and sides, and wherein the lid includes the coolant inlet.

3. The vacuum spray boiler cooling system of claim 2, wherein the lid includes the coolant spray apparatus.

4. The vacuum spray boiler cooling system of claim 3, wherein the coolant spray apparatus protrudes from the lid.

5. The vacuum spray boiler cooling system of claim 1, wherein the heat exchanger is a plate-fin heat exchanger.

6. The vacuum spray boiler cooling system of claim 5, wherein the plate-fin heat exchanger comprises serpentine-shaped chambers to carry the fluid.

7. The vacuum spray boiler cooling system of claim 1, wherein the components further comprise inlet tubing connected to the fluid inlet, wherein the thermal contact of the exhaust vent with the portion of the components is based on ambient conditions surrounding the system, from the fluid in the inlet tubing to the exhaust vent.

8. The vacuum spray boiler cooling system of claim 1, wherein the thermal contact of the exhaust vent with the portion of the components comprises conduction heating from the heat exchanger to the exhaust vent.

9. The vacuum spray boiler cooling system of claim 1, wherein the casing is aluminum.

10. The vacuum spray boiler cooling system of claim 1, wherein the fluid is hydraulic fluid and the coolant is water.

11. The vacuum spray boiler cooling system of claim 1, wherein the coolant spray apparatus is in thermal contact with the heat exchanger so as to prevent coolant freezing at the nozzles of the spray apparatus.

12. A vacuum spray boiler cooling system comprising:

a vacuum tank having a casing that encloses an internal space;

a plate-fin heat exchanger disposed in the internal space and configured to carry a working fluid through finned chambers;

a coolant spray apparatus mounted to a portion of the casing and configured to deliver a coolant through nozzles into the internal space;

a coolant inlet for supplying the coolant to the coolant spray apparatus;

a coolant exhaust port configured to remove vaporized coolant from the internal space; and one or more thermally conductive fins or members configured to conduct heat from the working fluid or the heat exchanger to the nozzles to inhibit coolant freezing at the nozzles.

13. The system of claim 12, wherein the nozzles are mounted to protrude into the internal space and are connected to the coolant inlet via a coolant channel integrated within the portion of the casing.

14. The system of claim 12, wherein the casing includes one or more sight glasses configured to permit visual inspection of spray and boiling inside the internal space.

15. The system of claim 12, wherein the one or more thermally conductive fins are configured to provide thermal coupling between the heat exchanger and the nozzles.

16. The system of claim 12, wherein the coolant spray apparatus comprises nozzles oriented to direct coolant onto the finned chambers of the heat exchanger.

17. The system of claim 12, wherein the coolant exhaust port is thermally coupled to both the heat exchanger and a flow path carrying the working fluid via conduction, convection, or radiation, depending on ambient pressure.

18. The system of claim 12, wherein the plate-fin heat exchanger comprises herringbone or serrated fins to enhance surface area for heat exchange.

19. The system of claim 12, wherein the coolant comprises a water-based mixture stored in a tank external to the system and introduced under residual tank pressure.

20. The system of claim 12, wherein the heat exchanger, the coolant spray apparatus, the coolant inlet, the coolant exhaust port, and the nozzles are integrated into a single monolithic structure.

* * * * *